US007730819B2

(12) United States Patent
Lowell et al.

(10) Patent No.: US 7,730,819 B2
(45) Date of Patent: Jun. 8, 2010

(54) WEAPON HAVING LETHAL AND NON-LETHAL DIRECTED ENERGY PORTIONS

(75) Inventors: Reid F. Lowell, Ontario, CA (US); Kenneth W. Brown, Yucaipa, CA (US); A-Lan V. Reynolds, Tucson, AZ (US); Alan A. Rattray, Alta Loma, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 12/349,664

(22) Filed: Jan. 7, 2009

(65) Prior Publication Data

US 2009/0119968 A1 May 14, 2009

Related U.S. Application Data

(62) Division of application No. 11/207,049, filed on Aug. 18, 2005, now Pat. No. 7,490,538.

(51) Int. Cl.
*F41H 13/00* (2006.01)
*F41C 27/00* (2006.01)

(52) U.S. Cl. ..... 89/1.11; 42/84

(58) Field of Classification Search ..... 89/1.11; 42/1.08, 84
See application file for complete search history.

(56) References Cited

U.S. PATENT DOCUMENTS 4,325,305 A 4/1982 Pastine
4,905,014 A * 2/1990 Gonzalez et al. ..... 343/909
5,968,401 A * 10/1999 Roy ..... 219/690
6,343,534 B1 * 2/2002 Khanna et al. ..... 89/1.13
6,487,950 B2 12/2002 Samland
6,799,499 B2 10/2004 Seregelyi et al.

(Continued)

FOREIGN PATENT DOCUMENTS

WO WO 2007022339 A2 2/2007

(Continued)

OTHER PUBLICATIONS

"Vehicle-Mounted Active Denial Technology(V-MADS)", GlobalSecurity.org, Internet Archived as shown in box at top on p. 7, (Jan. 2003), 6.

(Continued)

*Primary Examiner*—Bret Hayes
(74) *Attorney, Agent, or Firm*—Schwegman, Lundberg & Woessner, P.A.; Gregory J. Gorrie

(57) ABSTRACT

A portable weapon comprises a non-lethal portion and a lethal portion. The lethal portion may comprise a rifle, and the non-lethal portion may comprise a millimeter-wave directed energy weapon. The non-lethal portion may comprise a kit to add non-lethal capability to a lethal weapon. The non-lethal portion may comprise an output antenna to generate a high-power millimeter-wave initial wavefront, a main reflector, and a sub-reflector to reflect the initial wavefront to the main reflector. The main reflector may direct the reflected wavefront in a bore-sighted direction toward a target. The wavefront directed by the main reflector may have a power density selected to deliver a non-lethal deterring effect on the target. In some embodiments, the non-lethal portion may include a replaceable energy-storage module.

2 Claims, 8 Drawing Sheets

U.S. PATENT DOCUMENTS

| | | | | |
|---|---|---|---|---|
| 6,843,178 | B2 | 1/2005 | Wood et al. | |
| 7,490,538 | B2 | 2/2009 | Lowell et al. | |
| 2002/0108485 | A1 * | 8/2002 | Samland | 89/1.13 |
| 2005/0156743 | A1 | 7/2005 | Gallivan et al. | |

FOREIGN PATENT DOCUMENTS

| | | | |
|---|---|---|---|
| WO | WO 2007022339 | A3 | 2/2007 |

OTHER PUBLICATIONS

Hackett, K. E, et al., "Active Denial Technology", http://www.afrlhorizons.com/Briefs/Sept01/De0101.html>, Internet Article, (Retrieved from the Internet Jan. 22, 2007).

"European Application Serial No. 06813501.1, Office Action mailed Mar. 16, 2009", 10 pgs.

* cited by examiner

WEAPON HAVING LETHAL AND NON-LETHAL DIRECTED ENERGY PORTIONS

CROSS-REFERENCE TO RELATED APPLICATIONS

This application is a Divisional of U.S. application Ser. No. 11/207,049, filed Aug. 18, 2005 now issued as U.S. Pat. No. 7,490,538, the contents of which are incorporated herein by reference in its entirety.

TECHNICAL FIELD

Embodiments of the present invention pertain to portable weapons. Some embodiments pertain to directed-energy weapons and some embodiments pertain to kits for adding non-lethal capability to lethal weapons.

BACKGROUND

There are many difficult quickly changing situations in modern urban conflicts that security personnel must deal with. In modern urban conflicts, security personnel must execute dynamically changing missions that could shift rapidly between direct action, security patrols and civil stability. Among the mix of unarmed civilians, non-lethal combatants (e.g., rock throwing) and lethal combatants, it is often not immediately clear who is an innocent bystander and who poses an immediate threat to security personnel. Options for security personnel many times progress quickly from shouting to shooting. Modern urban conflicts many times require a delicate balance between the use of non-lethal force and the use of lethal force. Non-lethal weapons, when available, are generally carried separate from lethal weapons resulting in a potentially life-threatening delay for security personnel when switching between the types of weapons. Urban riot situations, for example, can easily escalate in a moment's notice and require security personnel to switch between a non-lethal response and a lethal response.

One problem with many non-lethal weapons is that they are largely ineffective over the range that lethal weapons are effective. For example, a non-lethal kinetic weapon that sends projectiles (e.g., rubber bullets) must have a reasonable range to maintain its nonlethality, however, the weapon becomes potentially lethal at close range when powerful enough to be used for longer ranges due to the initial velocity required to project the projectile over these longer ranges.

Thus, there are general needs for a non-lethal weapon that can easily be deployed along with a lethal weapon. There are also needs for a combined lethal/non-lethal weapon that has an effective non-lethal range comparable to its lethal range. There are also needs for a combined lethal/non-lethal weapon that allows security personnel to easily and quickly switch between non-lethal and lethal capabilities.

SUMMARY

A weapon having non-lethal and lethal portions is provided. The non-lethal portion directs a high-power millimeter-wave wavefront toward a target. The non-lethal portion comprises an output antenna to direct a high-power millimeter-wave initial wavefront at a sub-reflector, and a main reflector to reflect the wavefront to the target. The high-power wavefront may produce a non-lethal deterring effect on the target. The main reflector may be bore-sighted with the lethal weapon portion of the weapon to easily allow switching between non-lethal and lethal capabilities.

DETAILED DESCRIPTION

The following description and the drawings illustrate specific embodiments of the invention sufficiently to enable those skilled in the art to practice them. Other embodiments may incorporate structural, logical, electrical, process, and other changes. Examples merely typify possible variations. Individual components and functions are optional unless explicitly required, and the sequence of operations may vary. Portions and features of some embodiments may be included in or substituted for those of others. Embodiments of the invention set forth in the claims encompass all available equivalents of those claims. Embodiments of the invention may be referred to, individually or collectively, herein by the term "invention" merely for convenience and without intending to limit the scope of this application to any single invention or inventive concept if more than one is in fact disclosed.

A weapon in accordance with some embodiments of the present invention combines lethal capability with non-lethal capability allowing a user to easily switch between lethal and non-lethal force in a moment's notice. In many urban conflict situations, this ability may help save the lives of security personnel as well as the lives of innocent non-combatants. The non-lethal portion uses directed energy which, unlike many other non-lethal weapons (e.g., rubber bullets, taser, water cannons), generally causes no residual damage to a person fired upon. Because energy is the ammunition, the logistical burdens associated with conventional non-lethal weapons are significantly reduced.

Figure 1:
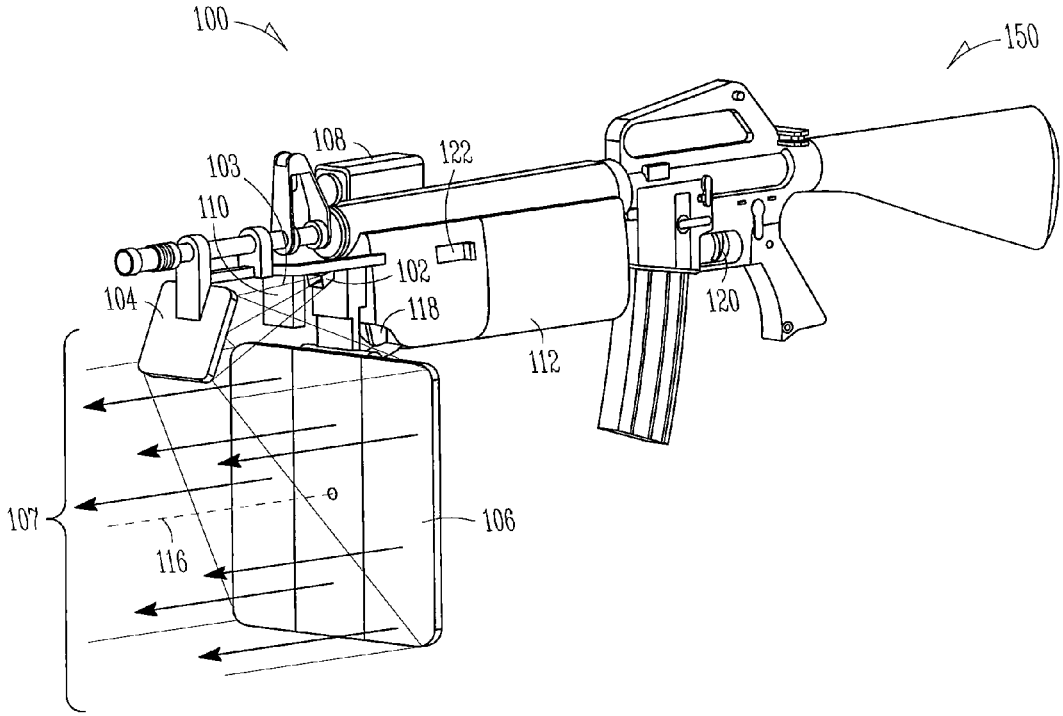
FIG. 1 is a perspective view of a weapon in accordance with some embodiments of the present invention.

FIG. 1 is a perspective view of a weapon in accordance with some embodiments of the present invention. Weapon 100 comprises non-lethal portion and lethal portion 150. Lethal portion 150 may be any lethal weapon including a rifle or machine gun. The non-lethal portion may comprise a directed energy weapon and may be bore-sighted or aligned with the lethal portion. In some embodiments, the non-lethal portion may be a kit allowing non-lethal capability to be added to a lethal weapon, although the scope of the invention is not limited in this respect.

Non-lethal portion of weapon 100 may comprise output antenna 102 to transmit a high-power millimeter-wave initial wavefront 103, main reflector 106, and sub-reflector 104 to reflect initial wavefront 103 to main reflector 106. Main reflector 106 may direct wavefront 107 in a bore-sighted direction toward a target.

In some embodiments, non-lethal portion of weapon 100 may also comprise rangefinder 108 to determine a range to the target, focus module 110 to focus wavefront 107, replaceable energy-storage module 112 to provide energy to the non-lethal portion, and laser designator 116 for designating the target. In some embodiments, non-lethal portion may also include trigger 118 to cause the generation of wavefront 107 and on-off switch 122. These elements are discussed in more detail below.

In some embodiments, wavefront 107 may comprise a millimeter-wave frequency, such as a W-band frequency between 94 and 96 GHz, although the scope of the invention is not limited in this respect. In some embodiments, wavefront 107 directed by main reflector 106 may have a power density selected to deliver a non-lethal deterring effect on the target. In some embodiments, wavefront 107 comprises a frequency selected to penetrate a shallow skin-depth (i.e., of less than five millimeters). In some embodiments, a power density of wavefront 107 at the target may be calculated and selected to cause a deterring effect by inducing pain on human skin. In some embodiments, wavefront 107 may comprise W-band millimeter-wave or higher frequency radiation selected to penetrate only a shallow skin-depth allowing the energy to heat the region of the skin's pain sensors, although the scope of the invention is not limited in this respect.

In some embodiments, main reflector 106 may be a collimating reflector to generate a collimated wavefront toward the target. The collimated wavefront may be substantially uniform in amplitude and/or substantially coherent in phase in a planar cross-section of a column of energy emanating from main reflector 106, although the scope the invention is not limited in this respect.

In some other embodiments, main reflector 106 may generate a converting wavefront which may converge at or near an intended target. In these embodiments, a convergence distance may be selected to provide a predetermined power density at or near a surface of the target. In some embodiments, main reflector 106 may generate a slightly diverging wavefront. In some embodiments, the focus of wavefront 107 (i.e., whether wavefront 107 is converging, collimated or diverging) may be at least partially controlled by focus module 110.

In some embodiments, main reflector 106 may be aligned with sights of lethal portion 150 of weapon 100. In some embodiments, the non-lethal portion may be a bore-sighted attachment kit to add non-lethal capability to a lethal weapon. The kit may be a "B-kit" add-on to a rifle, such as an M-16 rifle, although the scope of the invention is not limited in this respect.

Figure 2:
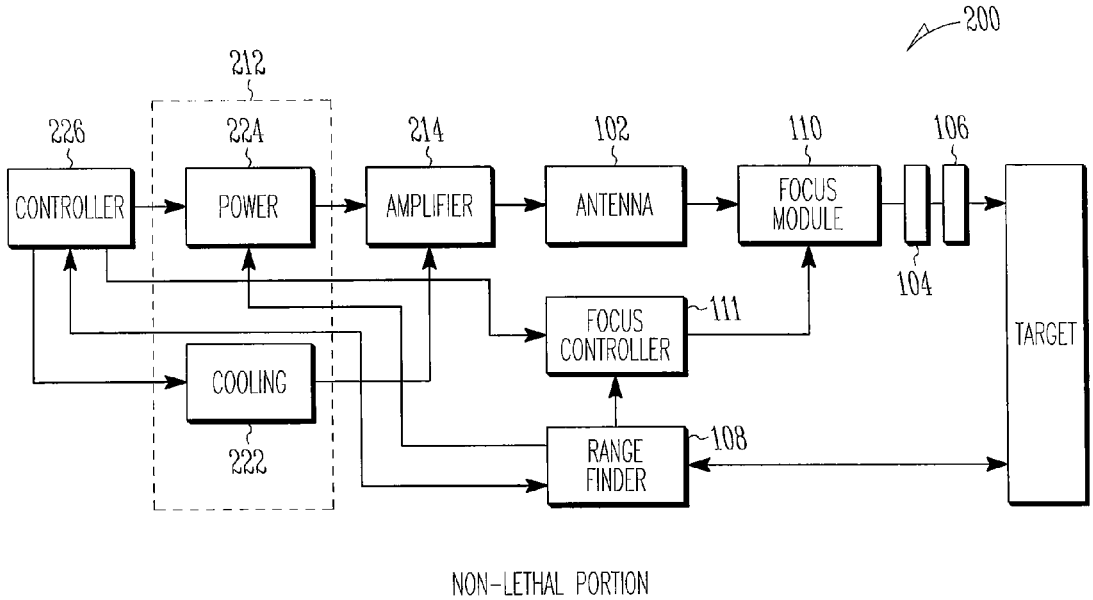
FIG. 2 is a functional block diagram of the non-lethal portion of the weapon of FIG. 1 in accordance with some embodiments of the present invention.

FIG. 2 is a functional block diagram of the non-lethal portion of the weapon of FIG. 1 in accordance with some embodiments of the present invention. Elements illustrated in FIG. 2 having the same reference number as elements in FIG. 1 may refer to the same element. As illustrated in FIG. 2, non-lethal portion 200 may include system controller 226 to control the operation of the various elements of non-lethal portion 200. Rangefinder 108 may determine a distance to the target and system controller 226 may determine the proper power density of wavefront 107 at or near the target based on the distance. System controller 226 may control the RF power output of amplifier 214 accordingly. On-off switch 122 may allow power to be turned off to the active elements of the non-lethal portion.

Referring to FIGS. 1 and 2 together, in some embodiments, laser designator 116 may be used to visually designate the target. Laser designator 116 may be bore-sighted with both the lethal portion and non-lethal portion. In some embodiments, rangefinder 108 may be aligned with laser designator 116. In some embodiments, rangefinder 108 comprises a laser-rangefinder, although the scope of the invention is not limited in this respect.

In some embodiments, laser designator 116 may generate a laser-beam in parallel to wavefront 107 and may comprise a laser-diode mounted on main reflector 106. In some embodiments, laser designator 116 may shine through a small hole in main reflector 106. In some alternate embodiments, a laser diode may be provided at or near output antenna 102 and a laser-beam may be reflected by optically reflective portions on reflectors 104 and 106 and may be provided parallel to wavefront 107.

Focus module 110 may change a focus of initial wavefront 103 generated by output antenna 102 based on a distance to the target. This may allow the power-density of wavefront 107 to be adjusted based on the distance to the target. In some embodiments, focus module 110 may be moveable by a user allowing the user to select a position for a focusing element based on the distance to the target. In some embodiments, the focusing element may be manually slidable by a user.

In some embodiments, focus module 110 comprises a millimeter-wave radio-frequency (RF) lens that may be positioned by focus controller 111 based on a distance to a target. In some embodiments, focus module 110 may include one or more RF lenses that may be switched in and out of the RF path by focus controller 111 to focus wavefront 107. In some embodiments, focus controller 111 may change the relative position of sub-reflector 104 to focus wavefront 107. In some other embodiments, system controller 226 may change the phasing of electronic phase shifters within main reflector 106 to change the focusing and phase distribution of wavefront 107.

In yet some other embodiments, focus module 110 may be an active-lens array in which a plurality of active array elements receive the wavefront, amplify the wavefront and retransmit the wavefront. In some embodiments, focus module 110 may provide a continually variable focusing distance, while in other embodiments; focus module 110 may provide selectable discrete focusing steps. In some embodiments, focus controller 111 and/or system controller 226 may configure main reflector 104, sub-reflector 104 and/or focus module 110 to generate a collimated wavefront, while in other embodiments; focus controller 111 and/or system controller 226 may configure main reflector 106, sub-reflector 104 and/or focus module 110 to generate a converting wavefront. In some other embodiments, focus controller 111 and/or system controller 226 may configure main reflector 104, sub-reflector 104 and/or focus module 110 to generate a slightly diverging wavefront.

In some embodiments, rangefinder 108 and/or focus module 110 are optional. In these embodiments, the focus of the non-lethal portion may be set at a predetermined distance or at infinity. In these embodiments, the power output of amplifier 214 may be varied, although the power output may also be set to a predetermined level.

In some embodiments, focus controller 111 may change a focus of focus module 110 in response to changes in a distance to the target provided by rangefinder 108. In some of these embodiments, a convergence point of wavefront 107 may be selected by system controller 226 to generate a predetermined power density at or near a target.

In some embodiments, amplifier 214 may be high-power millimeter-wave amplifier coupled to output antenna 102 to generate a high-power RF signal. In some embodiments, amplifier 214 may comprise a solid-state millimeter-wave amplifier comprising a plurality of either Silicon (Si) or Gallium-Arsenide (GaAs) semiconductor amplifier elements, although the scope of the invention is not limited in this respect. In some other embodiments, amplifier 214 comprises vacuum tube amplifier elements, although the scope of the invention is not limited in this respect. In some embodiments, additional amplifiers may not be needed when a powerful enough tube source is used for amplifier 214.

In some embodiments, output antenna 102 comprises a horn antenna and initial wavefront 103 may be a substantially spherical wavefront. In some embodiments, initial wavefront 103 may be generated from a pulsed W-band millimeter-wave signal generated by amplifier 214, although the scope of the invention is not limited in this respect.

Replaceable and removable energy-storage module 212 may provide electrical energy for the millimeter-wave amplifier 214 and/or other elements of the non-lethal portion. In some embodiments, energy-storage module 212 comprises power element 224 which may include, for example, either batteries or a fuel cell. In some embodiments, energy-storage module 212 may comprise a disposable battery or power pack, although the scope of the invention is not limited in this respect.

In some embodiments, weapon 100 may further comprise cooling element 222 to cool amplifier 214. In some embodiments, cooling element 222 may be part of replaceable energy-storage module 212, although the scope of the invention is not limited in this respect.

In some embodiments, cooling element 222 may circulate a phase-change fluid to cool amplifier 214. In some embodiments, the phase-change fluid may comprise a refrigerant, although the scope of the invention is not limited in this respect. In some embodiments, cooling element 222 may circulate a coolant and may include a reservoir to store the fluid. In some other embodiments, cooling element 222 may comprise a semiconductor-based thermo-electric cooling (TEC) element to remove heat from amplifier 214 using electric current, although the scope of the invention is not limited in this respect.

In some embodiments, cooling element 222 may use an expanding gas to cool the amplifier 214. In these embodiments, cooling element 222 may include a pressurized chamber to store the gas. In these embodiments, the chamber, including the gas therein, may be replaceable and may be replaced as part of energy-storage module 212. In these embodiments, the gas may be contained in a pressurized chamber that may be replaced when energy-storage module 212 is replaced. In some embodiments, the gas may comprise carbon-dioxide $CO_2$, although the scope of the invention is not limited in this respect.

Although FIG. 2 illustrates replaceable module 212 as including power element 224 and cooling element 222, the scope of the invention is not limited in this respect. In some embodiments, replaceable module may also include other elements of non-lethal portion 200.

In some embodiments, weapon 100 may further comprise lethal-weapon trigger 120 to fire the lethal portion of the weapon and non-lethal-weapon trigger 118 to fire the non-lethal portion by generating wavefront 107.

In accordance with some embodiments, non-lethal portion may operate as follows. Switch 122 may be turned on providing power to amplifier 214 and other elements of non-lethal portion and allowing range-finder 108 to determine a distance to a target. Laser-designator 116 may also be activated to designate the target to the user, however in some embodiments; laser-designator 116 may part of lethal portion 150 and may operate independent of the non-lethal portion. Focus module 110 may adjust the power output of amplifier 214 and/or may focus the various elements based on the target's distance. In some embodiments, the power output and focus may be adjusted based on a distance to the target to provide a predetermined power density (i.e., spot size) at the target. When trigger 118 is pulled, wavefront 107 is generated to deter the target. If use of non-lethal force is not successful, the user may easily switch to lethal force.

In some embodiments, lethal portion 150 comprises a machine gun; however, lethal portion 150 of weapon 100 may comprise almost any type of gun including hand-held guns. In some embodiments, the lethal portion may comprise a rifle or a machine gun, such as an M-16 rifle, although the scope of the invention is not limited in this respect.

In some embodiments, sub-reflector 104 may have a substantially flat millimeter-wave reflective surface. In some other embodiments, sub-reflector 104 has a millimeter-wave reflective surface comprising at least a portion of a substantially hyperboloidal, ellipsoidal or paraboloidal surface. Other specifically tailored reflective surfaces or lenses may also be used.

In some embodiments, main reflector 106 may comprise a geometrically-flat electrically-parabolic surface reflector antenna having a plurality of antenna elements to receive and retransmit an incident wavefront, although the scope of the invention is not limited in this respect. In these embodiments, the antenna elements may have circumferentially varying sizes and may be arranged around a center of the main reflector. In some embodiments, the antenna elements may have their electrical shapes optimized to generate either a collimating or converging wavefront of desired power densities. In some embodiments, the antenna elements may comprise a plurality of dual-polarized dipoles that circumferentially vary in size, although the scope of the invention is not limited in this respect. In some embodiments, the antenna elements may each provide approximately a 180 degree phase shift, although the scope of the invention is not limited in this respect. In some embodiments, the individual antenna elements may have varying sizes and shapes to receive the wavefront reflected by sub-reflector 104 and generate output wavefront 107 as either a collimated wavefront or a converting wavefront. An example of a reflector suitable for use as main reflector 106 may include the geometrically-flat electrically-parabolic surface reflector antenna disclosed in U.S. Pat. No. 4,905,014, although other reflective elements may also be suitable.

In some embodiments, main reflector 106 comprises an active reflect-array antenna comprising a plurality of active elements. Each element may have a receive antenna to receive portions of the reflected wavefront, an amplifier to amplify signals from the receive antenna, and a transmit antenna to transmit the amplified signals. In these embodiments, the plurality of active elements may generate an amplified wavefront in the direction toward the target. In these embodiments, the receive and transmit antennas may be orthogonally polarized.

In some embodiments, main reflector 106 may be coupled by a hinge to the weapon 100 to allow main reflector 106 to fold back when the non-lethal portion is not being used. In some embodiments, main reflector 106 is foldable and may fold into two or more flat sections. One of the sections may be coupled by a hinge to weapon 100, and the two or more flat sections may fold up at least partially around the weapon.

In some other embodiments, main reflector 106 comprises a single flat panel and is detachable from weapon 100. In these embodiments, main reflector 106 may be stored in a user's backpack, for example, although the scope of the invention is not limited in this respect. In some embodiments, main reflector 106 may be able to be snapped-on to weapon 100.

Figure 3A:
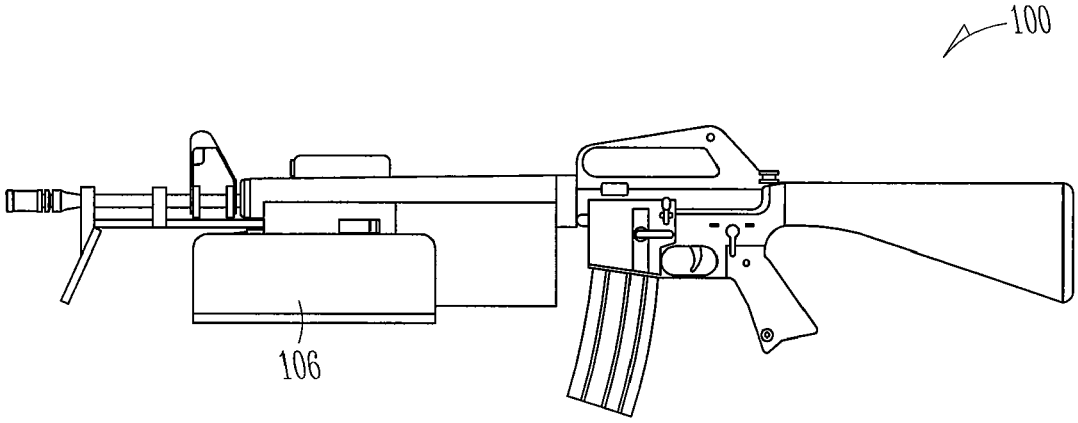
FIG. 3A is a side view illustrating the main reflector in a fully folded-up position in accordance with some embodiments of the present invention.
Figure 3B:
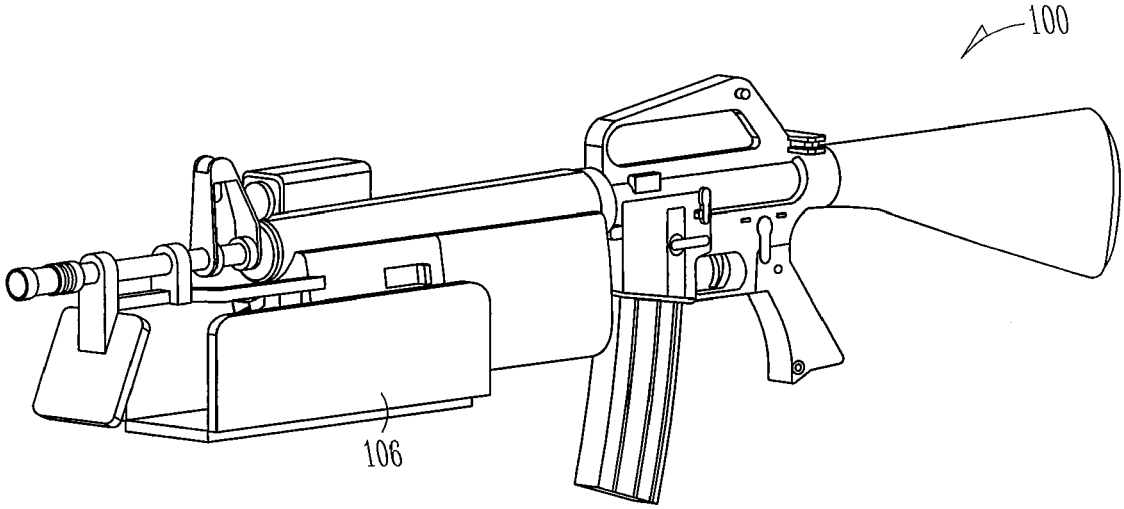
FIG. 3B is a perspective view illustrating the main reflector in a fully folded-up position in accordance with some embodiments of the present invention.
Figure 3C:
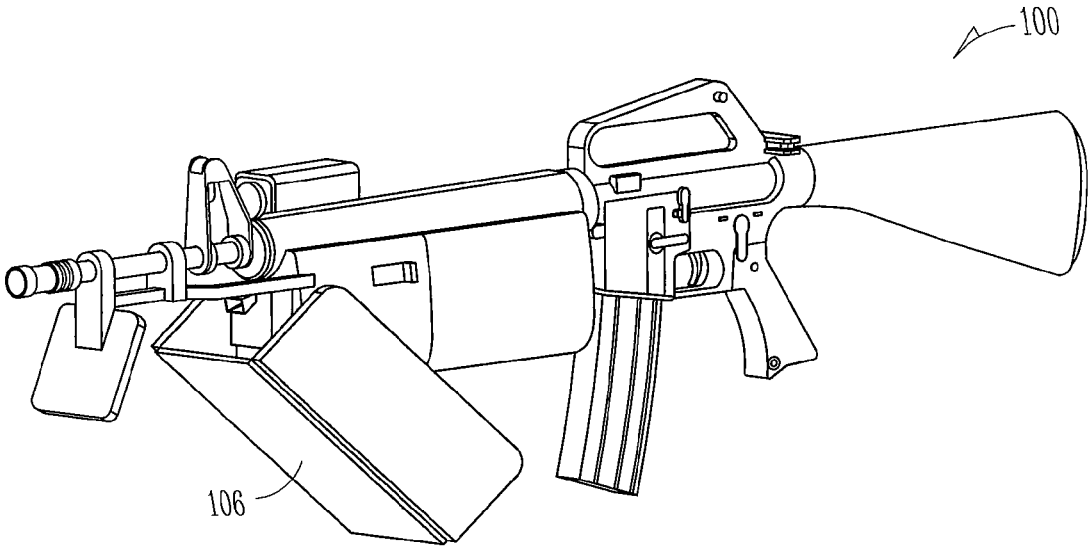
FIG. 3C is a perspective view illustrating the main reflector in a partially folded-up position in accordance with some embodiments of the present invention.
Figure 3D:
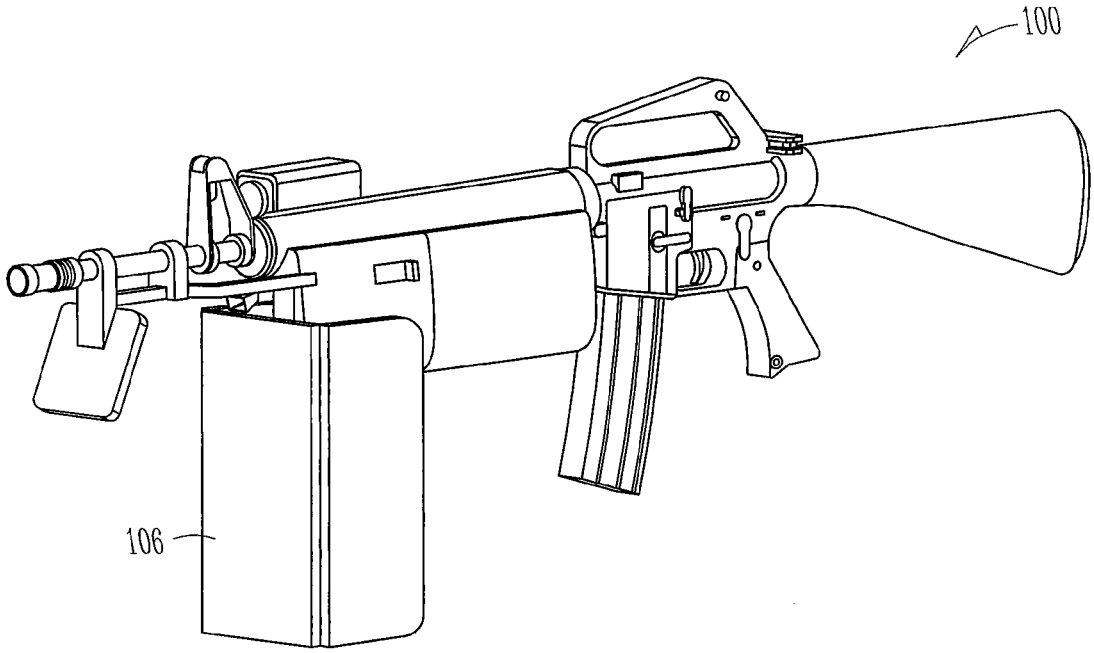
FIG. 3D is a perspective view illustrating wings of the main reflector folded-up in accordance with some embodiments of the present invention.
Figure 3E:
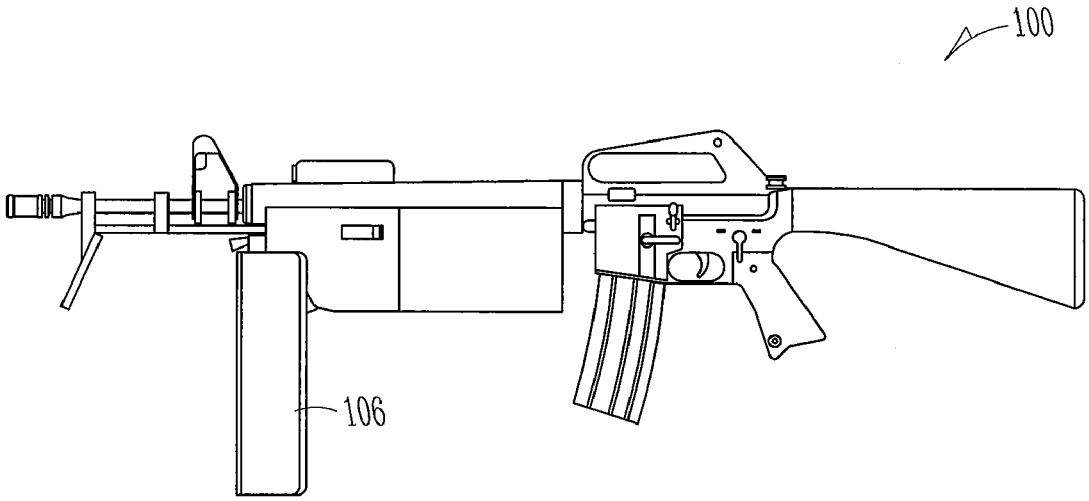
FIG. 3E is a side view illustrating wings of the main reflector partially folded-up in accordance with some embodiments of the present invention.
Figure 3F:
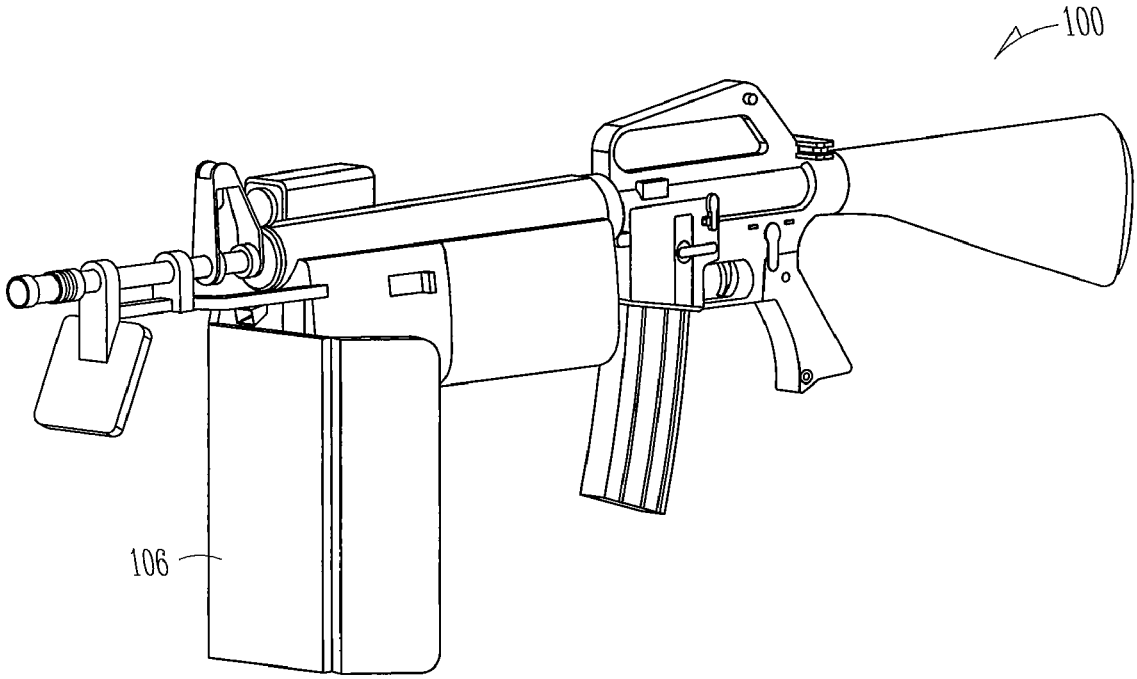
FIG. 3F is a perspective view illustrating wings of the main reflector partially folded-up in accordance with some embodiments of the present invention.

FIGS. 3A-3F illustrate embodiments of the present invention having a foldable main reflector in which main reflector 106 folds up and wraps around the body of weapon 100 when the non-lethal portion is not in use. FIG. 3A is a side view illustrating main reflector 106 in a fully folded-up position in accordance with some embodiments of the present invention. FIG. 3B is a perspective view illustrating main reflector 106 in a fully folded-up position in accordance with some embodiments of the present invention. FIG. 3C is a perspective view illustrating main reflector 106 in a partially folded-up position in accordance with some embodiments of the present invention. FIG. 3D is a perspective view illustrating wings of main reflector 106 folded-up in accordance with some embodiments of the present invention. FIG. 3E is a side view illustrating wings of main reflector 106 partially folded-up in accordance with some embodiments of the present invention. FIG. 3F is a perspective view illustrating wings of main reflector 106 partially folded-up in accordance with some embodiments of the present invention.

Figure 4A:
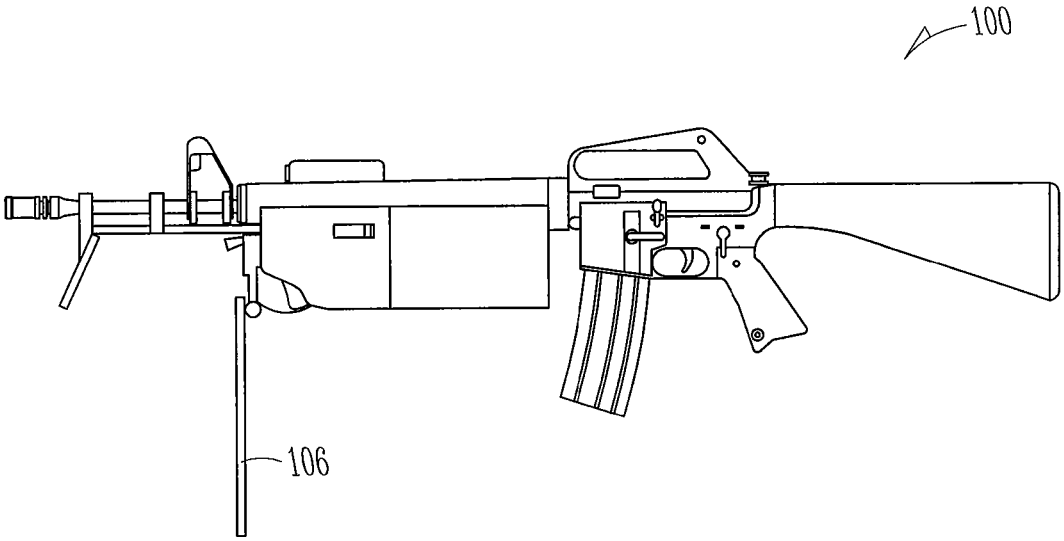
FIG. 4A is a side view illustrating the main reflector in a fully-deployed position in accordance with some embodiments of the present invention.
Figure 4B:
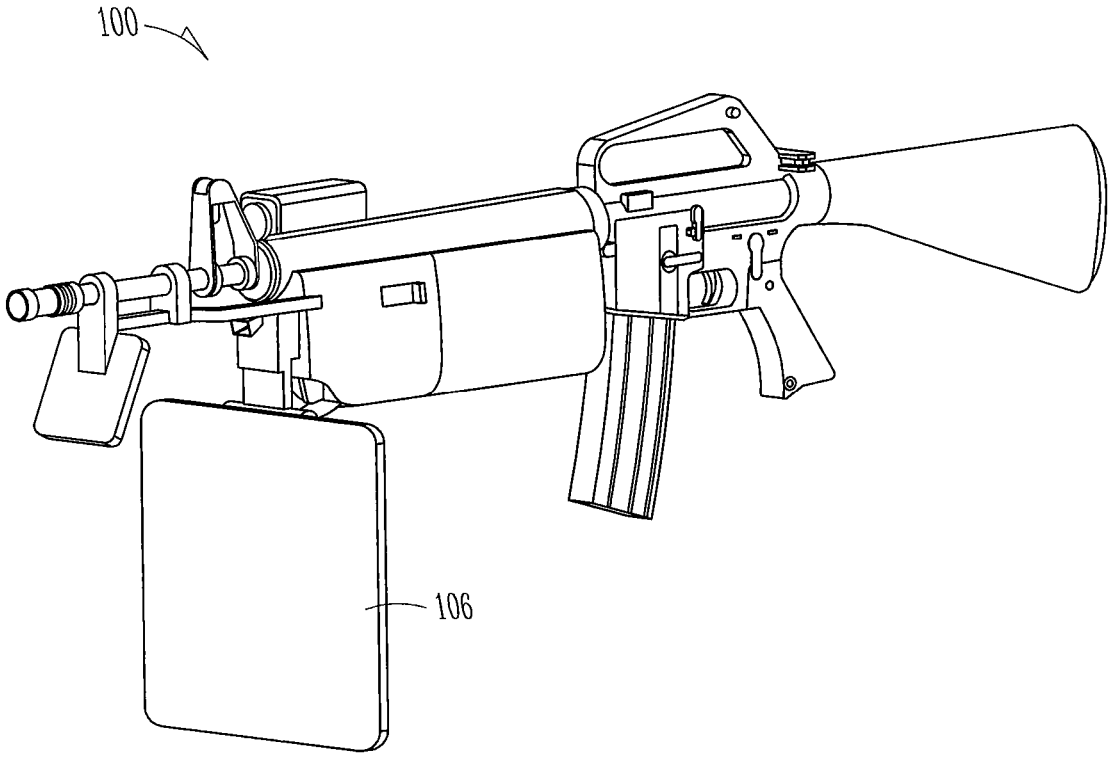
FIG. 4B is a perspective view illustrating the main reflector in a fully-deployed position in accordance with some embodiments of the present invention.
Figure 4C:
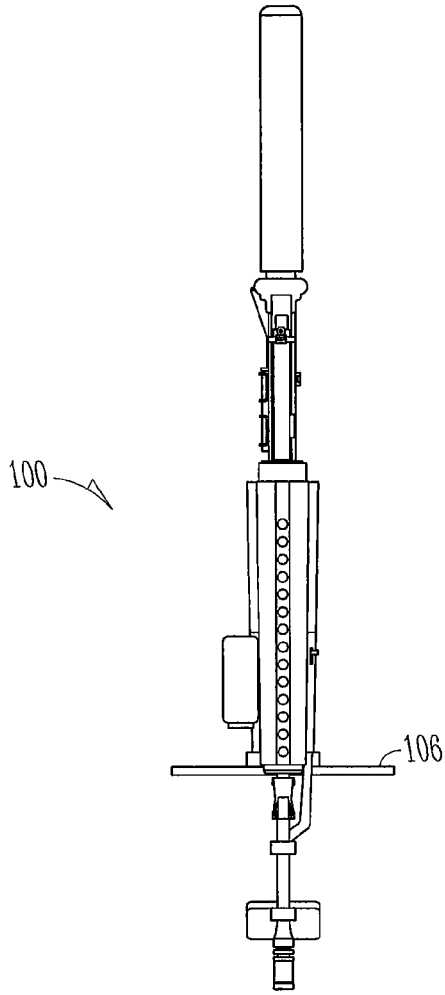
FIG. 4C is a top view of the weapon illustrated in FIGS. 4A and 4B.

FIG. 4A is a side view illustrating main reflector 106 in a fully-deployed position in accordance with some embodiments of the present invention. FIG. 4B is a perspective view illustrating main reflector 106 in a fully-deployed position in accordance with some embodiments of the present invention. FIG. 4C is a top view of the weapon illustrated in FIGS. 4A and 4B. In these embodiments, main reflector 106 may be coupled by a hinge to weapon 100 to allow main reflector 106 to fold back when the non-lethal portion is not being used. In these embodiments, main reflector 106 comprises a single flat panel and may be detachable from weapon 100. In these embodiments, main reflector 106 may be stored in a user's backpack, for example, although the scope of the invention is not limited in this respect. In some embodiments, main reflector 106 may be able to be snapped-on to weapon 100.

Figure 5A:
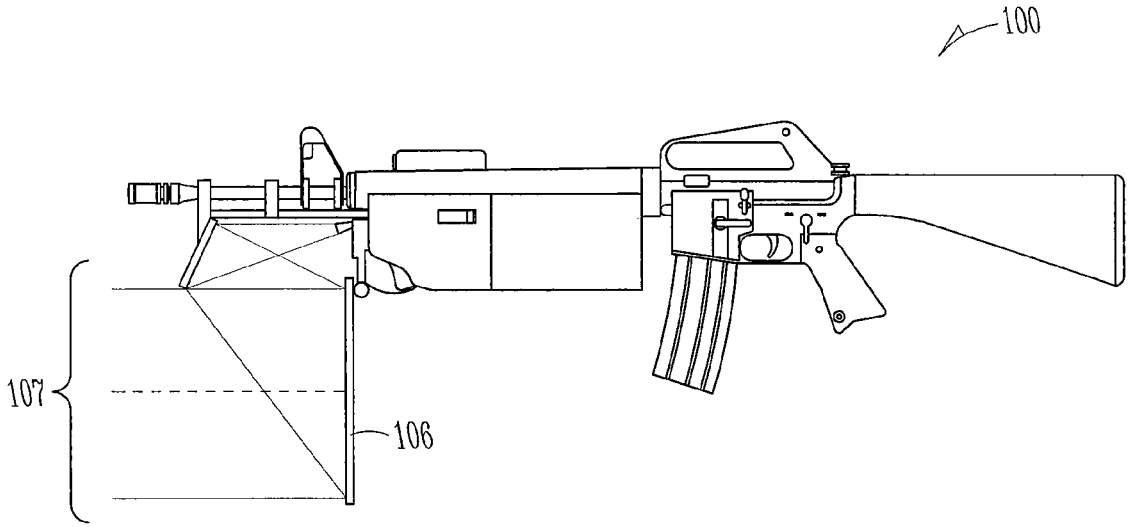
FIG. 5A is a side view illustrating the operation of the non-lethal portion of the weapon in accordance with embodiments of the present invention.
Figure 5B:
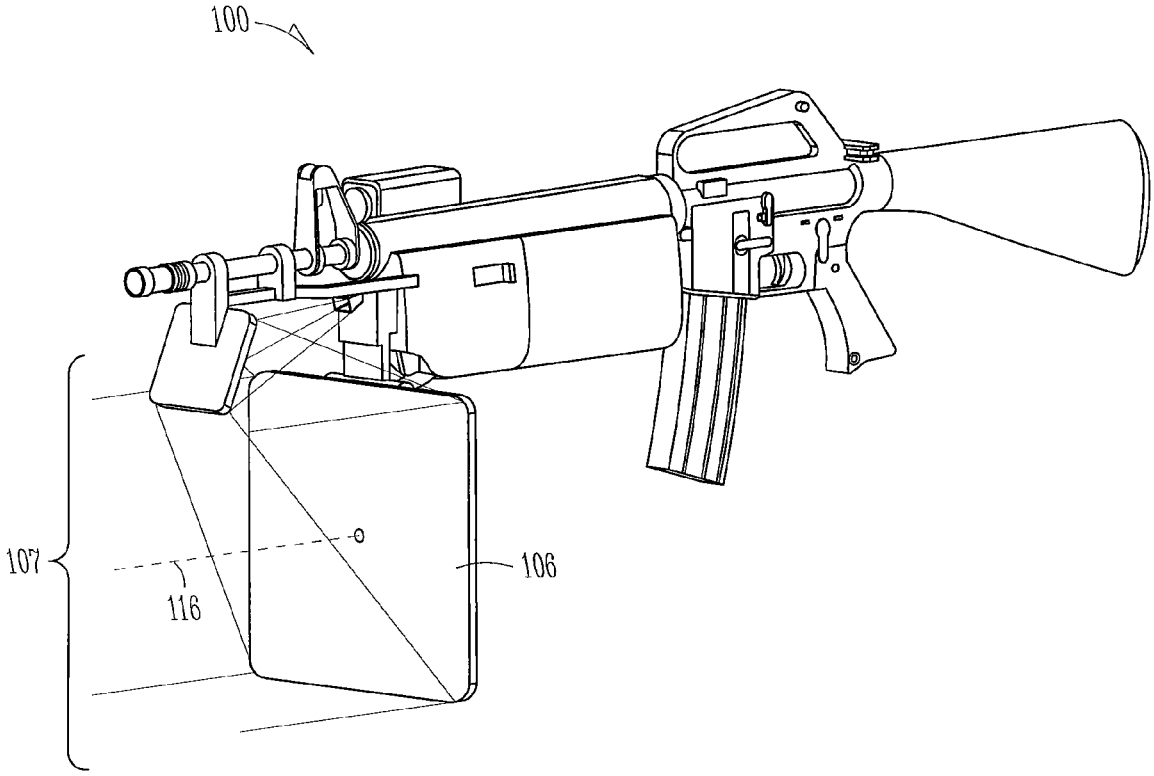
FIG. 5B is a perspective view illustrating the operation of the non-lethal portion of the weapon in accordance with embodiments of the present invention.

FIG. 5A is a side view illustrating the operation of the non-lethal portion of the weapon in accordance with embodiments of the present invention. FIG. 5B is a perspective view illustrating the operation of the non-lethal portion of the weapon in accordance with embodiments of the present invention. The non-lethal portion is illustrated generating wavefront 107 toward a target.

Figure 6A:
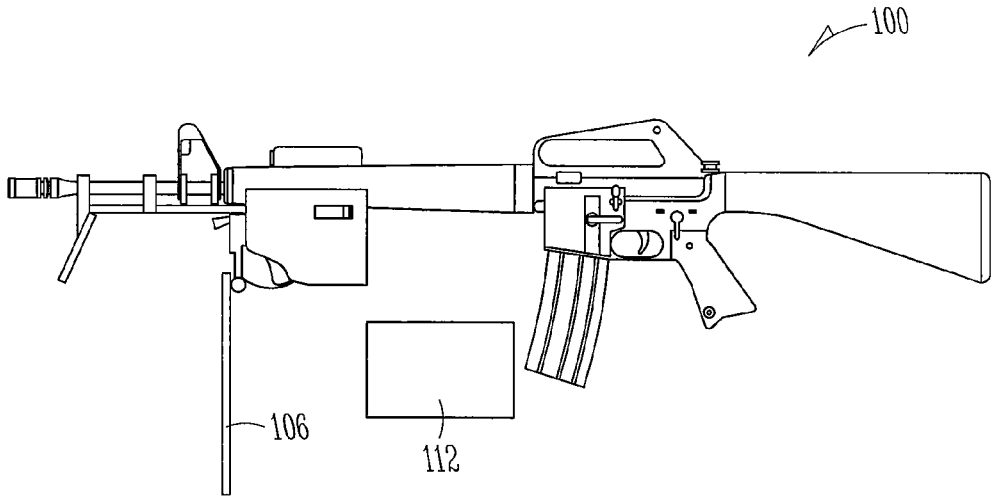
FIG. 6A is a side view illustrating the removable energy-storage module in accordance with embodiments of the present invention.
Figure 6B:
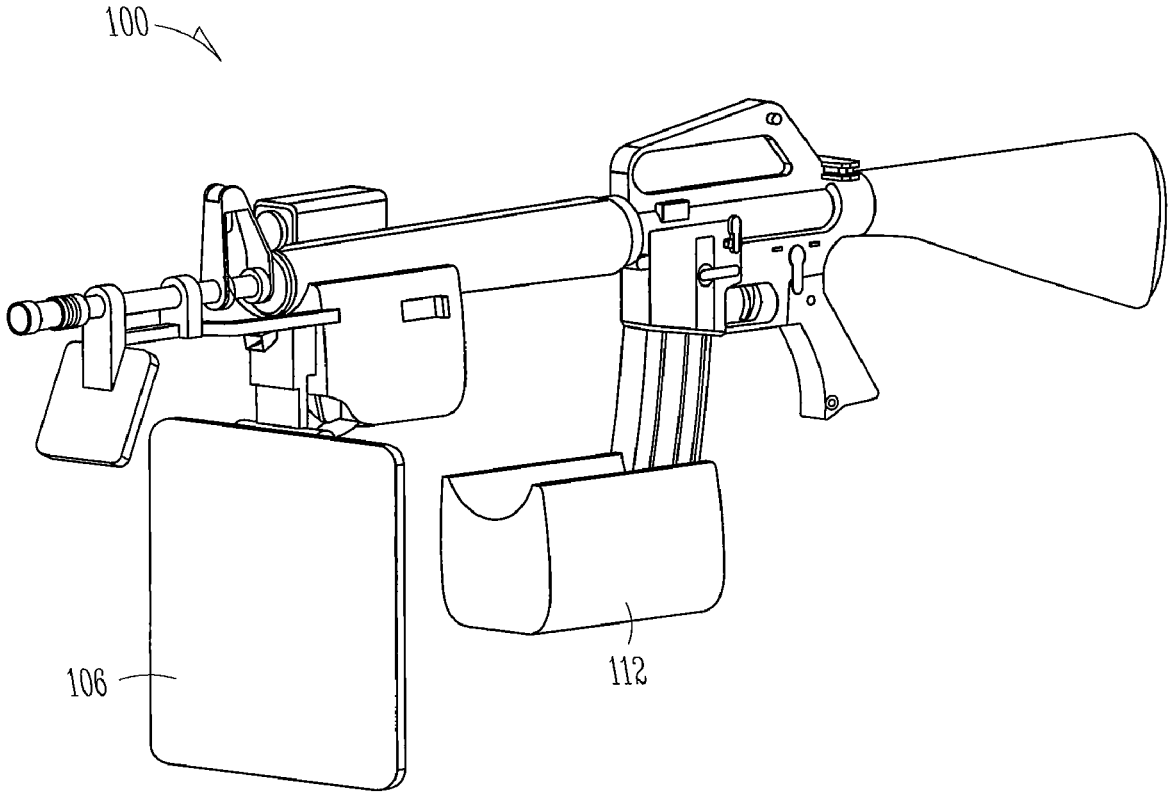
FIG. 6B is a perspective view illustrating the removable energy-storage module in accordance with embodiments of the present invention.

FIG. 6A is a side view illustrating the removable energy-storage module 112 in accordance with embodiments of the present invention. FIG. 6B is a perspective view illustrating the removable energy-storage module 112 in accordance with embodiments of the present invention.

Although non-lethal portion 200 (FIG. 2) is illustrated as having several separate functional elements, one or more of the functional elements may be combined and may be implemented by combinations of software-configured elements, such as processing elements including digital signal processors (DSPs), and/or other hardware elements. For example, some elements, such as system controller 226 (FIG. 2) and or focus controller 111 (FIG. 2) may comprise one or more microprocessors, DSPs, application specific integrated circuits (ASICs), and combinations of various hardware and logic circuitry for performing at least the functions described herein. In some embodiments, the functional elements of non-lethal portion 200 (FIG. 2) may refer to one or more processes operating on one or more processing elements.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims.

In the foregoing detailed description, various features may be occasionally grouped together in a single embodiment for the purpose of streamlining the disclosure. This method of disclosure is not to be interpreted as reflecting an intention that the claimed embodiments of the subject matter require more features than are expressly recited in each claim. Rather, as the following claims reflect, invention may lie in less than all features of a single disclosed embodiment. Thus the following claims are hereby incorporated into the detailed description, with each claim standing on its own as a separate preferred embodiment.

What is claimed is:

1. A kit to add non-lethal weapon capability to a portable lethal weapon, the kit comprising:

a replaceable energy-storage and coolant module;

a main reflector to direct a converging RF wavefront toward a target;

an output antenna to generate an initial wavefront;

a high-power millimeter-wave solid state amplifier coupled to the output antenna to generate a high-power signal for the output antenna;

a sub-reflector to reflect the initial wavefront to the main reflector;

a rangefinder to determine a distance to the target; and a laser designator to visually designate the target, wherein the replaceable energy-storage module provides electrical energy to the amplifier and includes a cooling element to cool the amplifier, wherein the wavefront directed by the main reflector has a power density selected to deliver a non-lethal deterring effect on the target, wherein a predetermined power density of the directed wavefront at or near the target is generated based on the distance, and wherein the laser designator is bore-sighted with both the lethal portion and non-lethal portion.

2. The kit of claim 1 further comprising a focusing element to change a focus of the initial wavefront generated by the output antenna based on a distance to the target and to cause the wavefront reflected by the main reflector to converge at or near the target to generate a predetermined power density at or near the target.

* * * * *